United States Patent [19]

Nishio et al.

[11] 4,261,085

[45] Apr. 14, 1981

[54] METHOD OF MAKING AN IGNITION PLUG INSULATOR HAVING AN ELECTRICALLY CONDUCTIVE END

[75] Inventors: Kanemitsu Nishio, Komaki; Shunichi Takagi, Tajimi, both of Japan

[73] Assignee: NGK Spark Plug Co., Ltd., Nagoya City, Japan

[21] Appl. No.: 968,094

[22] Filed: Dec. 8, 1978

[30] Foreign Application Priority Data

| | | | |
|---|---|---|---|
| Dec. 14, 1977 | [JP] | Japan | 52-149191 |
| Dec. 14, 1977 | [JP] | Japan | 52-149192 |
| Dec. 14, 1977 | [JP] | Japan | 52-149193 |

[51] Int. Cl.[3] ..... H01T 13/34; H01T 13/38

[52] U.S. Cl. ..... 29/25.12; 313/141; 313/143

[58] Field of Search ..... 313/131 A, 141, 143; 65/18; 29/25.12

[56] References Cited

U.S. PATENT DOCUMENTS

| | | | |
|---|---|---|---|
| 2,093,848 | 9/1937 | Randolph et al. | 313/143 X |
| 2,603,200 | 7/1952 | Feichter | 313/143 X |
| 2,803,771 | 8/1957 | Moore | 313/141 |
| 3,037,140 | 5/1962 | Schurecht | 313/131 A |
| 3,365,605 | 1/1968 | Linstedt | 313/143 X |
| 3,872,338 | 3/1975 | Wax | 313/141 X |

*Primary Examiner*—Palmer C. Demeo

*Attorney, Agent, or Firm*—Stevens, Davis, Miller & Mosher

[57] ABSTRACT

An ignition plug insulator provided at its front end with a closed ignition portion. The closed front end of the ignition portion is impregnated with an electric conductivity imparting material to form a ceramic electrode. Alternatively, the ceramic electrode may be incorporated in the closed front end of the ignition portion or filled in an axial bore provided in the insulation.

1 Claim, 19 Drawing Figures

METHOD OF MAKING AN IGNITION PLUG INSULATOR HAVING AN ELECTRICALLY CONDUCTIVE END

BACKGROUND OF THE INVENTION

1. Field of the Invention

This invention relates to an ignition plug insulator provided at its front end with a closed ignition portion.

2. Description of the Prior Art

In general, an ignition plug functions as a part of an electric ignition circuit to produce an electric spark between a center electrode and an outside electrode such that a high voltage discharge is guided into a combustion chamber so as to reliably ignite a mixed fuel gas and effect combustion. As a result, the ignition plug is exposed to high temperature and high pressure due to explosion of the mixed fuel gas and to sudden drop of the temperature and pressure due to suction of a new mixed fuel gas. The ignition plug insulator, therefore, is required to have a strength which is sufficient to not only withstand the high electric voltage but also withstand thermal shock and mechanical oscillation and shock. In addition, the ignition plug insulator is required to have a resistant property against chemical and thermal actions subjected thereto due to combustion gas and high temperature flame.

Purification of the exhaust gas from automobiles has recently become a very important matter. Automobiles incorporating apparatus for purifying such exhaust gas are now available in market. Meanwhile, the spread of frequency modulation radio receivers and mobile radios has raised another problem of eliminating noises due to electric waves emitted mainly from an ignition system of the automobile. It is desirous, therefore, to provide measures of eliminating these difficulties.

In order to eliminate both the public pollution due to exhaust gas and the electric wave disturbance, it is quite important to improve the ignition system, particularly its ignition source, that is, an ignition plug. All possible efforts are now exerted to study and develop the ignition plug.

The cruxes of the problem are as follows.

1. Alleviation of flame extinguishing action of a center electrode of an ignition plug.
2. Suppression of noise current produced during spark discharge of the ignition plug.

The flame extinguishing action of the center electrode results in a so-called miss firing of the ignition plug. As a result, as a concrete means for decreasing the miss firing, it has been the common practice to widen an electrode gap, for example, widen the usual electrode gap of 0.7 to 0.9 mm up to the order of 1.1 to 1.5 mm. In practice, such countermeasure can fairly improve the ignition ability of the spark plug.

However, the spark voltage across the electrodes becomes higher substantially in proportion to the electrode gap, and as a result, the above mentioned means for widening the electrode gap has the disadvantage that the ignition system must be to considerably changed in design by including a special transistor ignition source, for example, thereby increasing the manufacturing cost.

It has also been proposed to cover the front end of the center electrode with ceramic or the other refractory material for the purpose of alleviating the flame extinguishing action of the center electrode without increasing the discharge voltage and hence of improving the ignition property of the ignition plug. Such means, however, does not always bring satisfactory results owing to considerable difference between the thermal expansion coefficient of the covering material and that of the metal of the front end of the center electrode.

On the other hand, a so-called resistance incorporated plug provided in an axial bore of a procelain insulator with a resistor inserted or formed therein has been proposed for the purpose of suppressing the noise electric wave produced during the spark discharge of the ignition plug. Such resistance incorporated plug can effectively suppress generation of the noise electric wave and has widely been used in U.S.A. The demand for such resistance incorporated plug is also increasing in Japan. Particularly, in Canada where the electric wave regulation has really been adopted since September 1977, it is required to provide a resistance incorporated plug which can effectively prevent noise up to a high frequency band on the order of 1,000 MHz.

SUMMARY OF THE INVENTION

Experimental test have shown that it is important to locate a resistance body incorporated into the axial bore in the ignition plug porcelain insulator at a position which is as near as possible to an ignition point in order to improve the effect of preventing the high frequency noise, and that it is the most effective to provide a resistance film at the electrode surface. In order to ascertain the cause of such result, the inventors have effected the following experimental tests.

A new ignition plug was mounted on an engine and noise level was measured on the basis of a given measuring method.

After a lapse of time, the noise level was measured again and noted that the noise level was significantly decreased.

Another ignition plug whose center electrode was coated with carbon was used to measure the noise level and noted that the noise level also becomes significantly decreased.

This is because of the fact that carbon is absent on the electrode surface of the new ignition plug, that the ignition plug mounted in a combustion chamber becomes soiled with carbon after operation of the engine, and that carbon functions to decrease the noise level.

Then, various kinds of resistance films were formed on the discharge surface and the noise level was similarly measured.

The result obtained demonstrated the result that the higher the surface resistance the lower the noise level.

That is, the resistance film on the discharge surface functions to remove particularly the high frequency component.

The above described carbon or resistance film, however, is suddenly oxidized by a powerful spark energy and high temperature flame and hence disappears, thereby exhibiting no durability.

In the present invention, the course during which the carbon or resistance film was oxidized and eliminated was investigated for the purpose of clarifying means of obtaining a resistance film having a high and stable durability. Such investigations have yielded the result that the carbon or resistance film is oxidized and hence disappeared when it is exposed to the high temperature flame and that the influence of the spark discharge upon such oxidization of the carbon or resistance film is unexpectedly small.

As seen from the above, the carbon or resistance film is oxidized and eliminated due to the presence of the fire flame, so that the material less influenced by the fire flame will be investigated.

Ceramic material has a good property at a high temperature and hence is widely used as an insulating material. As a result, detailed investigations have been made on the fact whether or not the ceramic in itself can be used as an electrode of an ignition plug and on the fact whether or not the ceramic in itself can be made electrically conductive. The investigations have demonstrated the result in success that the ceramic in itself can be made electrically conductive by the measure to be described later. The ceramics have a specific heat which is smaller than that of metals, so that the flame extinguishing action of the ceramics is reduced. In addition, the electrode surface in itself inclusive of the resistance component renders it possible to remarkably reduce the noise level and provides a novel ignition plug having an excellent effect which could never be obtained by the conventional metal center electrode.

An object of the invention, therefore, is to provide an ignition plug insulator which has an excellent durability and ignition property and which can effectively reduce noise level produced from the ignition plug.

A feature of the invention is the provision of an ignition plug insulator comprising a hollow porcelain insulator having an axial bore extending therethrough and provided with an ignition portion, an outside electrode made integral with a metal fittingly engaged with said hollow porcelain insulator and facing toward said ignition portion, and a ceramic center electrode incorporated into said axial bore and inclusive of the front end of said ignition portion impregnated with an electric conductivity imparting material.

As seen from the above, in the present invention, in order to improve the durability of the ignition plug, the center electrode formed of a corrosion resistant metal is not directly opposed to the outer electrode. The use of such measure ensures no consumption of the center electrode and provides the important advantage that the flame extinguishing action of the center electrode can be eliminated so as to effectively improve the ignition property of the ignition plug.

Preferable modes of carrying out the invention are as follows.

1. The electric conductivity imparting material is formed of at least one metal selected from the group consisting of Cu, Fe, Co, Mn, Cr, Ti and La, alloys, oxides or oxide semiconductors thereof.
2. The front end of the ignition portion of the hollow porcelain insulator has a thickness within a range between 0.2 mm and 2.0 mm.
3. The ceramic center electrode has a resistance value of at most 10 MΩ.

Another feature of the invention is the provision of a method of manufacturing an ignition plug insulator comprising the steps of shaping an insulator raw material of a porcelain containing a large amount of alumina into a hollow cylindrical body having an axial bore extending therethrough and closed at its front end, calcinating said hollow cylindrical body to provide a hollow cylindrical porous body, incorporating chips of powders formed of electric conductivity imparting material or oxide semiconductor formed of at least one element selected from the group consisting of Cu, Fe, Co, Mn, Cr, Ti and La into said axial bore, and heating said hollow cylindrical porous body up to a usual sintering temperature under a neutral or oxidizing atmosphere, thereby providing a ceramic center electrode at the front end of the ignition portion of the ignition plug parcelain insulator and simultaneously sintering said ignition plug porcelain insulator.

The ignition plug insulator according to the invention will be described as compared with a conventional ignition plug insulator provided with a metal center electrode with reference to the accompanying drawings,

BRIEF DECRIPTION OF THE DRAWINGS

Figure 5:
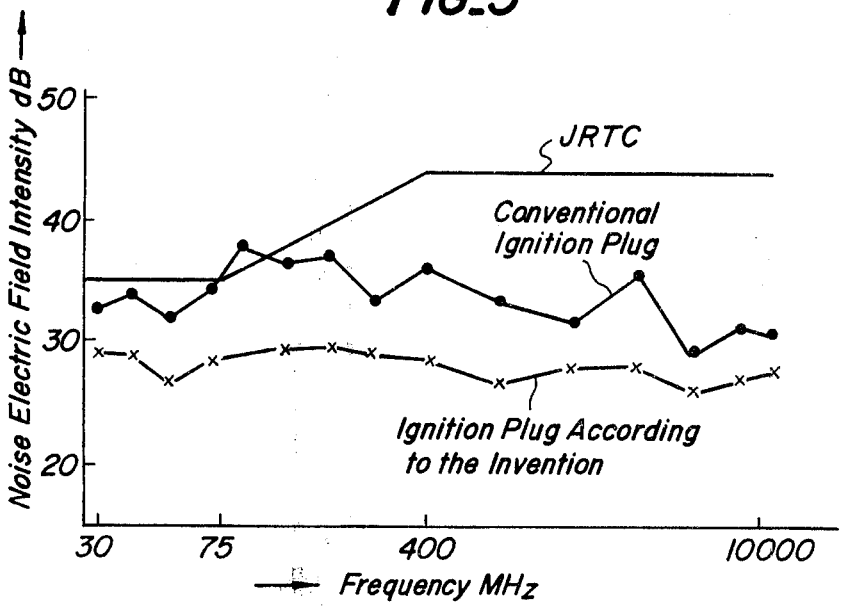
Figure 6:
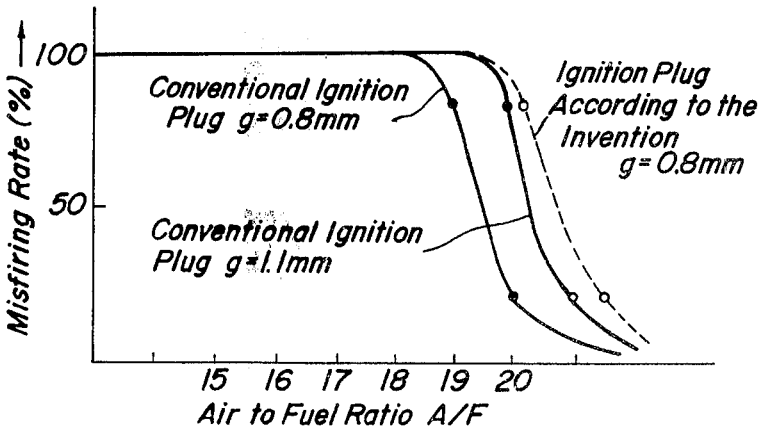
Figure 7:
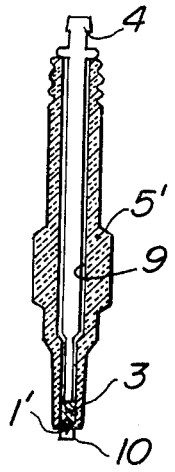
Figure 8:
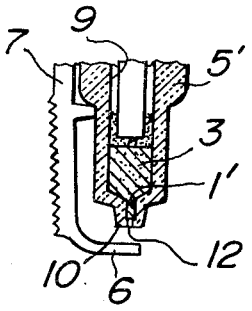
Figure 9:
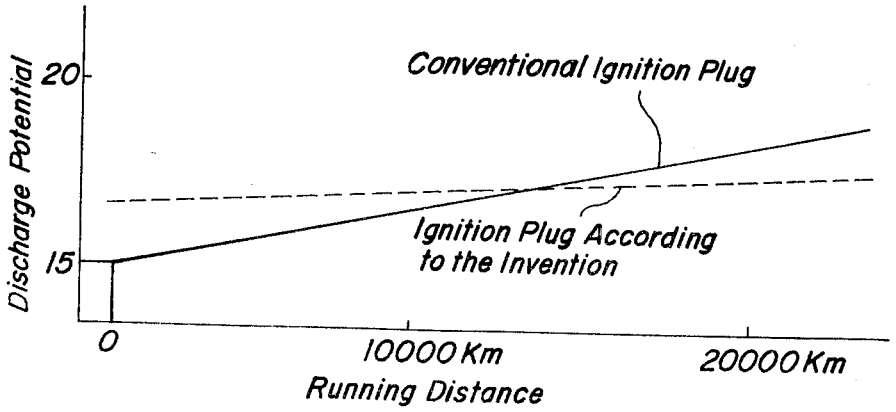
Figure 10:
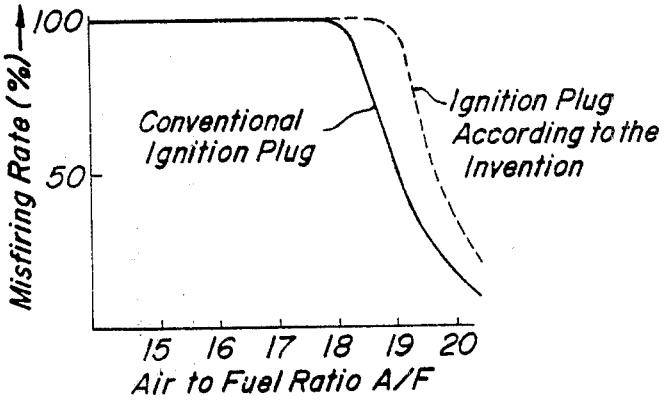
Figure 11:
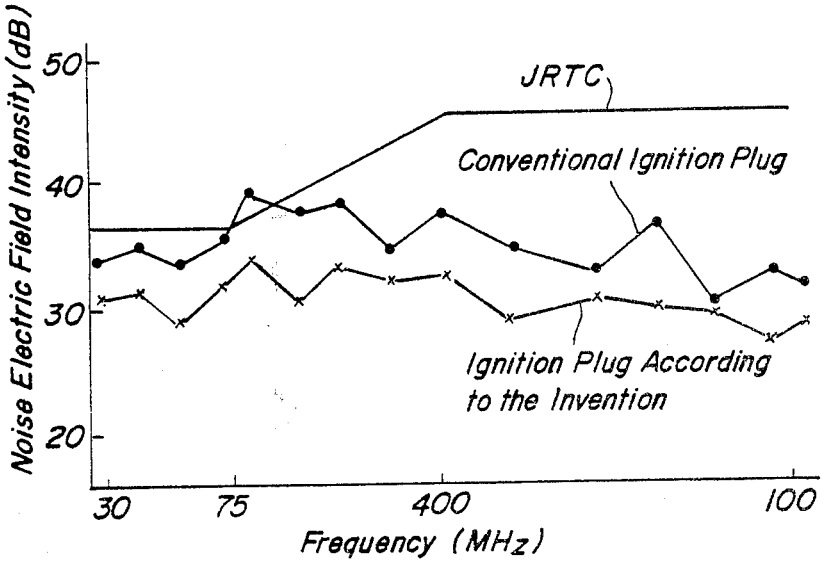
Figure 12A:
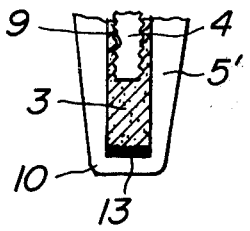
Figure 12B:
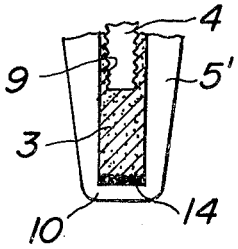
Figure 13:
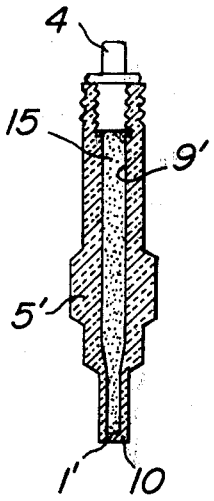
Figure 14:
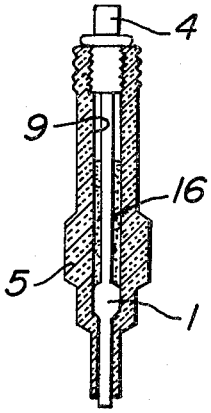
FIG. 14 PRIOR ART
Figure 15:
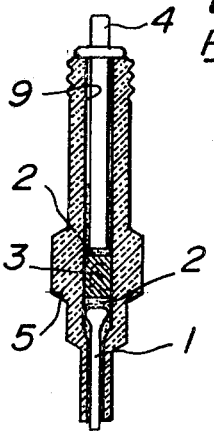
FIG. 15 PRIOR ART

FIGS. 4*a* to 4*d* are diagrammatic views illustrating successive steps of a method of manufacturing an ignition plug insulator according to the invention;

FIG. 5 is an explanatory graph of noise electric field intensity as a function of frequency of an ignition plug insulator according to the invention in comparision with that of a conventional ignition plug insulator;

FIG. 6 is an explanatory graph of misfiring rate as a function of an air to fuel ratio of an ignition plug insulator according to the invention in comparison with that of a conventional plug insulator;

FIG. 7 is a longitudinal sectional view of another embodiment of an ignition plug insulator according to the invention;

FIG. 8 is a partial enlarged view of the ignition plug insulator shown in FIG. 7;

FIG. 9 is a graph illustrating durability of an ignition plug insulator according to the invention as compared with that of a conventional ignition plug insulator;

FIG. 10 is a graph illustrating an ignition property of an ignition plug insulator according to the invention as compared with that of a conventional ignition plug insulator;

FIG. 11 is a graph illustrating a noise reducing effect of an ignition plug insulator according to the invention as compared with that of a conventional ignition plug insulator;

FIG. 12*a* is a diagrammatic cross-sectional view of a further embodiment of an ignition plug insulator according to the invention;

FIG. 12*b* is a diagrammatic cross-sectional view of a still further embodiment of an ignition plug insulator according to the invention;

FIG. 13 is a longitudinal sectional view of another embodiment of an ignition plug insulator according to the invention; and FIGS. 14 and 15 are longitudinal sectional views of two kinds of conventional ignition plug insulators comparable with the ignition plug insulator according to the invention shown in FIG. 13.

DETAILED DESCRIPTION OF THE PREFERRED EMBODIMENTS

Figure 1:
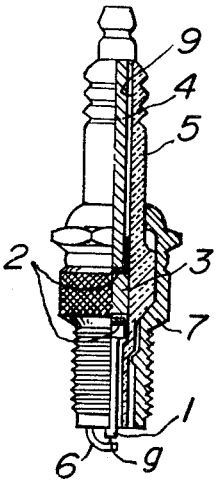
FIG. 1 PRIOR ART
FIG. 1 is a front elevational view of a conventional ignition plug insulator, partly shown in section.
Figure 2:
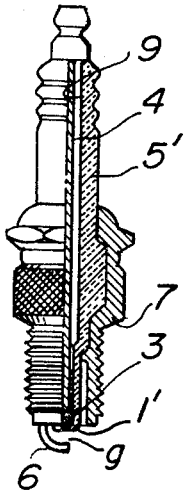
FIG. 2 is a front elevational view of one embodiment of an ignition plug insulator according to the invention, partly shown in section.

FIG. 1 shows a conventional resistance incorporated ignition plug insulator, a right-half thereof shown in section and FIG. 2 similarly shows one embodiment of an ignition plug insulator according to the invention.

The conventional plug insulator shown in FIG. 1 comprises a metal center electrode 1 formed of Ni alloy, upper and lower semiconductive sealing material 2, 2, a resistance body 3 sandwiched between the upper and lower semiconductive sealing material 2, 2 and a terminal shaft 4. These electrodes, material and shaft are hermetically sealed in an axial bore 9 in a hollow insulator 5 formed of a porcelain insulator. In FIG. 1, reference numeral 6 designates a grounded outside electrode and 7 a metal fitting.

FIG. 2 shows one embodiment of an ignition plug insulator 5' according to the invention. The ignition plug insulator 5' is engaged with a metal fitting 7 in the same manner as in the case of FIG. 1.

The ignition plug insulator 5' is characterized in that the front end of an ignition portion opposed to the grounded outside electrode 6 is composed of a bag-shaped, hollow porcelain insulator which is particularly closed at the front end of its ignition portion, and that the closed front end is impregnated with an electric conductivity imparting material, thereby providing a ceramic electrode 1' used instead of the metal center electrode 1. As a result, it is possible to arrange the resistance body 3 in the rear of the ceramic electrode 1', that is, in the closed end of the axial bore 9 and to connect the resistance body 3 to the terminal electrode 4 without requiring the semiconductive sealing material 2.

The above mentioned ignition plug insulator according to the invention has a number of advantages. In the first place, it is not necessary to protrude the metal center electrode 1 from the front end of the insulator 5. Even if an electrode gap g is made equal in length to that of the conventional plug, the use of the ceramic electrode 1' formed of materials whose specific heat and heat conductivity are considerably different from each other ensures an effective alleviation of flame extinguishing action, thereby improving the ignition property of the ignition plug. Secondly, the ceramic electrode 1' in itself has resistance, so that it is possible to effectively prevent the noise from producing during the spark discharge. Third, the axial bore 9 in the hollow insulator 5' is closed at its front end and hence the sealing material 2 can be omitted, thereby providing an ignition plug insulator which is simple in construction and in manufacturing steps.

As described above, the ignition plug insulator according to the invention may be formed of a porcelain containing a large amount of alumina in the same manner as in the case of the conventional ignition plug insulator.

As the electric conductivity imparting material for constituting the ceramic electrode 1' at the front end of the ignition portion of the ignition plug porcelain insulator 5', it is the simplest to use Cu under oxygenless condition. It has been recognized that the same effect as that of Cu can be obtained by electric conductivity imparting material formed of at least one metal selected from the group consisting of Fe, Cr, Co, Mn, Ti and La, alloys, oxides or oxide semiconductors thereof.

Experimental tests have shown the result that the object of the invention can be attained by a ceramic electrode having a thickness within a range between 0.2 mm and 2.0 mm.

In addition, experimental tests have demonstrated the result that a ceramic electrode 1' having a resistance value within a range between 100Ω and 10 MΩ can effectively prevent the noise from producing without increasing the spark discharge voltage.

As the resistance body 3 sealed into the axial bore 9 of the ignition plug insulator 5' and brought into direct contact with the ceramic electrode 1', use may be made of the following material which has been used for the conventional resistance body incorporated into the conventional ignition plug insulator.

Barium borate glass—40 parts by weight
Zirconia powders—60 parts by weight
Glycerine—1 to 4 parts by weight
Resistance value stabilizing agent such as TiC, $TiO_2$, $Nb_2O_5$ or the like—1 to 10 parts by weight To the resistance body 3 may eventually be added metal powders such as Fe, B or the like and an aggregate such as $Si_3N_4$ or the like. Alternatively, as the resistance body 3, use may be made of glass containing $Al_2O_3$, $SiO_2$ for improving the heat resistant property thereof.

Heretofore, it has been the common practice to provide a center electrode formed of metal, such as Ni alloy, W, Pt or the like, a semiconductive material such as non-metal or the like. For example, the metal center electrode has been molded from ceramic such as alumina, clay, glass or the like added with metals such as Pt, Ni, Cr, W or the like or added with metal carbide such as SiC, WC. In addition, the metal center electrode has been formed of oxide semiconductor.

But, the metal center electrode must be formed of material which is different in kind from the ignition plug insulator formed generally of porcelain containing a large amount of alumina. Such metal center electrode material must be prepared by a step separated from a step of manufacturing the ignition plug insulator and then formed into the ignition plug insulator and bonded with the latter in the same manner as in the case of the conventional metal center electrode. Such convention center electrode is troublesome in manufacturing operation, has an unstable ability, and hence could not be used in practice. It has also been proposed to shape the metal center electrode when the porcelain insulator is sintered. In this case, it is difficult to adopt the condition under which the porcelain insulator is sintered to the condition under which the semiconductor ceramic is shaped into the center electrode. As a result, the ignition plug insulator aimed at could not be obtained.

The inventors have studied the method of manufacturing a ceramic center electrode having a low specific resistance and developed a method of making the center electrode integral with the front end of the porcelain insulator and making the front end only of the porcelain insulator semiconductive.

In the method of manufacturing the ignition plug insulator according to the invention, the front end of the porcelain insulator is bag-shaped beforehand and then the bag-shaped end is impregnated with metal or semiconductor material. The method according to the invention is capable of manufacturing a novel ignition plug insulator provided with the ceramic semiconductor electrode aimed at.

The present embodiment of an ignition plug insulator according to the invention will now be described in greater detail with reference to the following practical example.

EXAMPLE

Figure 3:
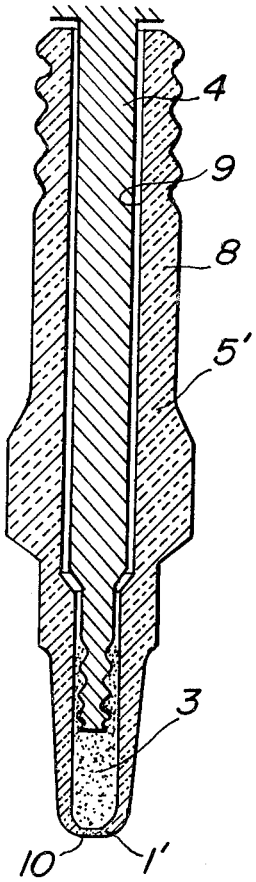
FIG. 3 is a enlarged cross-sectional view of the ignition plug insulator according to the invention shown in FIG. 2.

As shown in FIG. 3, raw material containing a large amount of alumina was press shaped into an insulator raw material body 8 provided with an ignition portion whose front end is closed so as to form a bag-shaped insulator. The insulator raw material body 8 thus shaped was calcinated at 1,000° C. for 1 hour to obtain a porous body having an axial bore 9 extending therethrough and closed at its base 10.

Figures 4A, 4B, 4C, 4D:
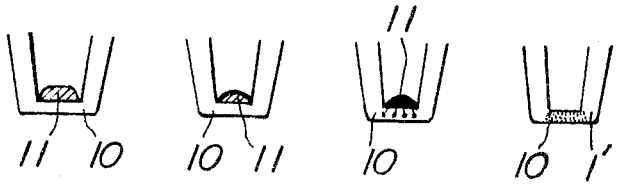

In the closed base 10 of the axial bore 9 was inserted a massive chip 11 formed of 0.05 g of oxygenless copper (99.9%) as shown in FIG. 4*a*. The massive chip 11 under hermetically sealed condition was sintered at a gradually rising temperature at a rate of 80° C./h up to 1,600° C. and then was cooled. During this time, the massive chip 11 was heated by a neutral flame to gradually oxidize the surface thereof as shown in FIG. 4*b* and became molten at its melting point of about 1,100° C. as shown in FIG. 4C. Then, the alumina ignition end portion was impregnated with the molten copper as shown in FIG. 4*d*.

Copper is considerably wettable on alumina in air and a part of the copper surface is oxidized into CuO and $Cu_2O$ which react with alumina to form a spinel.

During the steps of melting the massive chip 11 at about 1,000° C. shown in FIGS. 4*b* and 4*c*, insufficient progress of the sintering process causes alumina to remain porous, thereby easily wet alumina with copper.

Experimental tests have demonstrated the result that the massive chip 11 is particularly effective for impregnating alumina with Cu, $Cu_2O$ and CuO. If use is made of copper powders, their specific surface area becomes large to expedite the progress of oxidation thereof. As a result, substantially all of the copper powders are changed into CuO. Alumina impregnated with CuO does not reduce the specific resistance to a value which is smaller than a given required value.

As described before, the ignition plug porcelain insulator according to the invention manufactured by simultaneously sintering the ceramic electrode and the insulator is capable of making the resistance of its center ceramic electrode a value within a range between 0.1 MΩ and 3 MΩ when the ceramic electrode 1' has a thickness of 0.5 mm. If the resistance of the ceramic center electrode 1' becomes higher than 100 MΩ, the ceramic center electrode 1' could no more function as the semiconductor, but is electrically punctured in the use of the ignition plug insulator, thereby rendering the ceramic center electrode 1' inoperative.

It is extremely easy to fill an ignition plug insulator shaped as above described and having a front end formed of an electrically conductive ceramic with resistance material powders under pressure and then to heat the assembly so as to provide a resistance incorporated ignition plug insulator.

In the present example, 0.4 g of semiconductive resistance material formed of glass, semiconductive material, metal powders and carbon was charged into an axial bore 9 having a diameter of 3.2 mm and the assembly was heated at 900° to 1,000° C. for about 10 minutes and then a terminal shaft 4 was urged against the semiconductive resistance material so as to hermetically seal it and provide a joined body. In the present example, the lower end of the terminal shaft 4 was separated from the closed base 10 of the insulator 8 by 5 mm by taking the heat absorption of the terminal shaft 4 from the insulator 8 into consideration.

To the joined body was fitted a metal fitting 7 as shown in FIG. 2 to provide an ignition plug insulator.

Both the ignition plug insulator thus provided according to the invention as shown in FIG. 2 and the conventional resistance incorporated ignition plug shown in FIG. 1 were subjected to experimental tests defined by JRTC so as to effect comparative measurement of noise electric field intensity.

FIG. 5 shows the result of such comparative measurement effected on a 2 cylinder, 125 cc, 4 cycle engine.

FIG. 6 shows the result of comparative measurement on ignition property effected on a 4 cylinder, 2,000 cc, 4 cylinder electronic fuel jet type engine for passenger cars. In the conventional ignition plug insulators, the electrode gap g was made 0.8 mm and 1.1 mm, respectively, while in the ignition plug insulator according to the invention, the electrode gap g was made 0.8 mm. The relation between the air to fuel ratio and the misfiring rate of both the conventional ignition plug insulator and the ignition plug insulator according to the invention was investigated, the relation of the conventional ignition plug insulator being shown by full line curves and the relation of the ignition plug insulator according to the invention being shown by a dotted line curve.

As seen from FIGS. 5 and 6, the ignition plug insulator provided with the ceramic semiconductive electrode according to the invention can significantly reduce the noise electric field intensity and hence can conspicuously prevent the noise and exhibit an excellent ignition property if compared with those of the conventional ignition plug insulator. In addition, as seen fron FIG. 6, the ignition plug insulator according to the invention having the electrode gap g of 0.8 mm can exhibit an ignition property which corresponds to that of the conventional ignition plug insulator having the electrode gap g of 1.1 mm.

As stated hereinbefore, in the ignition plug insulator according to the invention, the axial bore in the porcelain insulator is closed at its front end of the ignition portion to provide the ceramic electrode at the base having a relatively thin thickness and locally impregnated with electric conductivity imparting material. The use of the measured described provides the important advantage that the ignition plug insulator according to the invention can not only improve the ignition property and durability, but also reduce the noise level.

FIG. 7 shows another embodiment of an ignition plug insulator according to the invention.

In the present embodiment, an axial bore 9 of an ignition plug insulator 5' is closed at the front end 10 of an ignition portion facing toward an outside electrode 6 (refer to FIG. 8) made integral with a metal fitting 7 engaged with the ignition plug insulator 5'. Into the axial bore 9 is inserted a resistance body 3 which closely makes contact with the thin end wall 10 of the ignition portion so as to constitute a ceramic center electrode 1' incorporated into the ignition plug insulator 5'. In the present embodiment, the ignition plug insulator 5' is formed of raw material of porcelain containing 95% of $Al_2O_3$. The porcelain raw material is press formed and then sintered at about 1,600° C. The thickness of the front end 10 of the ignition portion is made 0.5 mm by taking the following facts into consideration. That is, the thicker the front end 10 of the ignition portion the higher the discharge voltage required for forming the discharge path. In addition, the thickness of the front end 10 of the ignition portion on the order of 0.5 mm renders it possible to prevent the voltage required for the spark discharge from becoming higher and to manufacture the ignition plug insulator 5' in an easy manner.

The front end 10 of the ignition portion 5' has a withstand voltage of about 15 kV/mm in oil. If a spark gap between the grounded outside electrode 6 made integral with the metal fitting 7 and the front end 10 of the ignition portion is made 0.7 mm and a voltage of about 20 kV is applied across the spark gap, the front end 10 of the ignition portion facing toward the outside electrode 6 is subjected to electrical puncture to produce a small hole 12 having a diameter of 50μ–100μ and shown in FIG. 8 by an enlarged scale. As a result, it is possible to provide a discharge path even when the closed end 10 of the ignition portion of the insulator 5 is not impregnated with the electric conductivity imparting material so as to provide the ceramic center electrode 1'.

The resistance body 3 may be formed of material having composition which is the same as described with reference to the previous embodiment shown in FIG. 2.

Experimental tests on the ability of the present embodiment of an ignition plug insulator according to the invention as compared with that of a conventional ignition.

(1) Durability

In the conventional ignation plug insulator, the consumption of the exposed metal center electrode results in an increase of the electrode gap and hence of the discharge voltage, thereby determining the effective life of the ignition plug insulator.

On the contrary, in the ignition plug insulator of the present embodiment, the consumption of the electrode mainly due to oxidation thereof is prevented by the closed end wall of the ignition portion, and as a result, the consumption of the center electrode incorporated into the ignition plug insulator becomes significantly small.

FIG. 9 shows a discharge potential of a conventional ignition plug insulator by a full line and a discharge potential of the ignition plug insulator according to the present embodiment by dotted lines, the spark gap defined by the discharge path which is the total sum of the electrode gap between the outside electrodes and the front end of the ignition portion and the thickness of the end wall of the ignition portion of the ignition plug insulator according to the present embodiment being the same as that of the conventional ignition plug insulator which is 0.7 to 0.8 mm. As seen from FIG. 9, the discharge voltage of a new ignition plug insulator of the present embodiment is slightly higher than that of the conventional ignition plug insulator.

In FIG. 9, the maximum voltage required when a passenger car mounted thereon with 2,000 cc, 4 cylinder engine is accelerated from 40 km/h as a function of the running distance thereof of the ignition plug insulator of the present embodiment was compared with that of the conventional ignition plug insulator.

(2) Ignition Property

The heat conductivity of the front end of the ignition portion of the ignition plug insulator of the present embodiment exposed to combustion gas at 800 to 1,000° C. is $1\times10^{-2}$ to $2\times10^{-2}$ cal/cm·sec·°C. which is considerably smaller than that of the center electrode formed of Ni alloy of the conventional ignition plug insulator. As a result, the flame extinguishing action due to the spark is alleviated and henced the ignition property is improved.

FIG. 10 shows the misfiring rate as a function of the air to fuel ratio A/F of the conventional ignition plug insulator by a full line curve as compared with that of the ignition plug insulator of the present embodiment by dotted line curve, both the ignition plug insulators being mounted on a 2,000 cc, 4 cylinder electronic fuel injection engine.

(3) Effect of Preventing Noise

FIG. 11 shows the experimental test result on the ignition plug insulator of the present embodiment as compared with that on the conventional ignition plug insulator when the noise electric field intensity is measured as a function of the frequency thereof based on the standard defined by JRTC. As seen from FIG. 11, the ignition plug insulator of the present embodiment can significantly reduce the noise level owing to the fact that the resistance body 3, that is, the center electrode 1' is located at a position which is nearer the ignition point than the conventional ignition plug insulator.

Experimental tests have shown the result that if the ignition plug insulator is tested under such severe condition that the front end of the ignition plug insulator becomes overheated due to preignition or the like, the semiconductive glass composition of the resistance body 3 eventually becomes molten and leaks out of the closed front end 10 of the ignition so as to form a bridge between the front end 10 and the outside electrode 6, thereby inducing the misfiring, and that use must be made of glass having a considerably high softening point of at least 900° C., for example.

In the present embodiment, in order to prevent the above mentioned leakage of the molten glass, use is made of glass having a composition whose softening point is on the order which does not impede the workability thereof.

FIG. 12 a shows a further embodiment of an ignition plug insulator according to the invention. In the present embodiment, a number of small chips 13 having an exellent heat resistant property and formed of a noble metal such as Pt or the like, metal such as Cr, Ni, Fe or the like and alloys thereof are inserted in the axial bore 9. Then, a resistance body 3 and a terminal shaft 4 are inserted under pressure one upon the other in the order as mentioned above so as to provide a metal center electrode 1' incorporated into the ignition plug insulator. In addition, the metal center electrode 1' is firmly bonded with the end wall 10 of the ignition portion of the ignition plug insulator 5'. For this purpose, the noble metal such as Pt or the like, metals such as Cr, Ni, Fe or the like or respective alloy powders are sintered simultaneously when the ignition plug insulator 5' is sintered.

FIG. 12*b* shows a still further embodiment of an ignition plug insulator according to the invention. In the present embodiment, in order to avoid a crack failure induced during sintering of the ignition plug insulator due to the difference between the thermal expansion of the metal and that of the porcelain, use is made of at most 50% by volume of alumina porcelain raw material powders which are the same as the porcelain raw material of the ignition plug insulator and mixed with the metal powders. The mixed powders 14 are inserted in the axial bore 9 and these are sintered. During the sintering step, the mixed powders 14 are covered with oxide film and firmly bonded with alumina. When a resistance body 3 is sealed by means of sealing glass, the mixed powders 14 are firmly bonded with the sealing glass, thereby providing an ignition plug insulator having an excellent durability.

Experimental tests have yielded the result that the ignition plug insulators shown in FIGS. 12*a* and 12*b* exhibit substantially the same abilities as those illustrated with reference to FIGS. 9 to 11.

As stated hereinbefore, the ignition plug insulator of the present embodiment comprising a center electrode completely covered with an ignition portion porcelain has the advantage that it can improve its durability and ignition property, that it can be stored or transported without deteriorating it by the influence of the atmosphere and that it can reduced the noise level.

FIG. 13 shows another embodiment of an ignition plug insulator according to the invention and FIGS. 14 and 15 show conventional ignition plug insulators comparable with the present embodiment shown in FIG. 13. The conventional plug insulator shown in FIG. 14 comprises an insulator 5 provided therein with an axial bore 9. In the axial bore 9 is sealed a metal center electrode 1 by a bonding agent formed of insulating powders 16. The metal center electrode 1 is electrically connected to a terminal shaft 4. The conventional plug insulator shown in FIG. 15 comprises an insulator 5 provided therein with an axial bore 9. In the axial bore 9 are sealed a metal center electrode 1 and a terminal shaft 4. Between the metal center electrode 1 and the terminal shaft 4 is interposed a resistance body 3 which is secured to the center electrode 1 and terminal shaft 4 by means of electrically conductive glass layers 2. The ignition plug insulator of the present embodiment shown in FIG. 13 comprises an insulator 5' provided therein with a bag-shaped axial bore 9' closed at the front end 10 of an ignition portion. In the closed axial bore 9' is completely filled with a sintered semiconductor 15 up to a terminal shaft 4.

The ignition plug insulator 5' is formed of porcelain raw material containing at least 90% by weight of alumina and is press shaped. The shaped body is calcined at 1,000° C. for several minutes to make the shaped body porous.

Semiconductive material consisting of 80% by weight of $Fe_2O_3$, 10% by weight of $TiO_2$, 5% by weight of $Cr_2O_3$ and 5% by weight of $La_2O_3$ is heated at 1,150° C. for 1 hour and then pulverized into powders 15. These powders 15 are filled in the closed axial bore 9' of the porous porcelain insulator 5' and then the assembly is sintered to a sintering temperature of alumina by substantially usual method. During sintering the semiconductive powders are reacted with the porcelain insulator 5' and diffused into the front end 10 of the ignition portion of the porous porcelain insulator 1', thereby providing a semiconductive ceramic elecrtrode 1'.

In the ignition plug insulator thus obtained, the total resistance of the sintered semiconductor inclusive of the semiconductive ceramic electrode 1' at the front end 10 of the ignition portion is about 2 MΩ.

Experimental tests on a sample porcelain have demonstrated the result that a resistanced value of the sintered semiconductor having a length of 50 mm and cut to expose the surface whose resistance is to be measured was about 200 kΩ.

In the present embodiment, the terminal shaft 4 may be brought into engagement with and fused to the upper end of the porcelain insulator 5' by means of an inorganic bonding agent or sealing glass after the semiconductive powders 15 in the axial bore 9' have been sintered.

Experimental tests of comparing the ignition plug insulator of the present embodiment shown in FIG. 13 with the conventional ignition plug insulator shown in FIG. 15 have yielded the result that the ignition plug insulator of the present embodiment is slightly inferior in the temperature coefficient and voltage coefficient of the resistance value of the sintered semiconductor to the conventional ignition plug insulator shown in FIG. 15, but can prevent the electric wave noise produced due to the spark discharge owing to the fact that in the ignition plug insulator of the present embodiment the ceramic electrode as a whole has a resistance, thereby usefully preventing public nuisance due to the electric wave.

As stated hereinbefore, the ignition plug insulator of the present embodiment requires no metal center electrode to be exposed at the ignition portion to the high temperature combustion gas and hence can eliminate the problem of consuming the center electrode and of extinguishing flame produced therefrom, which has been encountered with the prior art ignition plug insulator, thereby significantly improving the durability and ignition property of the ignition plug insulator. In addition, the ignition plug insulator of the present embodiment can usefully prevent disturbances due to noise and electric wave and requires no step of assembling the metal center electrode, thereby significantly reducing the manufacturing cost.

What is claimed is:

1. A method of manufacturing an ignition plug insulator comprising the steps of shaping an insulator raw material of a porcelain containing a large amount of alumina into a hollow cylindrical body having an axial bore extending therethrough and closed at its front end, calcinating said hollow cylindrical body to provide a hollow cylindrical porous body, incorporating chips or powders formed of electric conductivity imparting material or oxide semiconductor formed of at least one element selected from the group consisting of Cu, Fe, Co, Mn, Cr, Ti and La under oxygenless condition into said axial bore, and heating said hollow cylindrical porous body up to a usual sintering temperature, thereby providing a ceramic center electrode at the front end of the ignition portion of the ignition plug porcelain insulator and simultaneously sintering of said ignition plug porcelain insulator.

* * * * *